United States Patent [19]

Kiesling et al.

[11] Patent Number: 5,039,909

[45] Date of Patent: Aug. 13, 1991

[54] ELECTRIC LAMP AND HOLDER FOR SUCH A LAMP

[75] Inventors: Manfred Kiesling, Oirsbeek, Netherlands; Werner Schlagheck, Aachen, Fed. Rep. of Germany; Josef Rothkranz, Vaals, Netherlands

[73] Assignee: U.S. Philips Corporation, New York, N.Y.

[21] Appl. No.: 499,916

[22] Filed: Mar. 26, 1990

[30] Foreign Application Priority Data

Apr. 24, 1989 [NL] Netherlands ..... 8901020

[51] Int. Cl.[5] ..... H01J 17/18

[52] U.S. Cl. ..... 313/623; 313/318; 439/611; 439/619; 362/285; 362/287

[58] Field of Search ..... 439/611, 619, 699; 313/623, 318; 362/285, 287, 288

[56] References Cited

U.S. PATENT DOCUMENTS 4,365,396 12/1982 Baba et al. ..... 439/699

4,485,326 11/1984 Hellwig et al. ..... 313/318

4,957,499 9/1990 Horiuchi et al. ..... 439/699

FOREIGN PATENT DOCUMENTS 1214736 12/1970 United Kingdom ..... 313/318

*Primary Examiner*—Donald J. Yusko

*Assistant Examiner*—Nimeshkumar D. Patel

*Attorney, Agent, or Firm*—Robert J. Kraus

[57] ABSTRACT

The electric lamp has a lamp vessel (1) having a pinch seal (2) having two major side faces (7, 8) and two minor side faces (9, 10), the latter being provided with grooves (11, 12). The grooves (11, 12) are widened and deepened towards a respective major side face (7, 8), into which they merge. The lamps can be arranged in a holder by a purely translatory movement and this holder is then elastically deformed. The holder has rigid holding members, which engage into a respective groove and can move therein by subjecting the lamp to a rotation.

3 Claims, 1 Drawing Sheet

ELECTRIC LAMP AND HOLDER FOR SUCH A LAMP

BACKGROUND OF THE INVENTION

The invention relates to an electric lamp comprising a glass lamp vessel having a pinch seal and an axis, an electric element in the lamp vessel, and current supply conductors extending from the electric element through the pinch seal to the exterior.

The pinch seal has an end face transverse to the axis of the lamp vessel, two opposite major side faces and two opposite minor side faces.

Each of the minor side faces has a groove, which extends as far as a respective major side face. The grooves have the axis of the lamp vessel as the axis of symmetry.

Such a lamp is known from DE AS 16 39 093 corresponding to Great Britain Patent 1,214,736.

The invention further relates to a holder for the lamp.

The known lamp has for its object to provide a solution for the problem that lamps whose pinch seal is provided with grooves cooperating with resilient holding members in the lamp holder can become detached from the lamp holder if they are subjected to shocks or vibrations.

In the known lamp, this problem is solved in that the grooves extend obliquely with respect to the axis of the lamp vessel in such a manner that, from the relevant major side face, they approach the end face of the pinch seal more and more closely. When a lamp is arranged in a holder, the lamp must be inserted deeply and must then be rotated about its axis in order to introduce rigid holding members of the lamp holder into the grooves. The lamp is then given a final position which is located less deeply in the lamp holder than upon insertion. When the lamp is arranged in the lamp holder, the lamp therefore performs a bayonet-like movement. Elastic means of the lamp holder hold the lamp in a final position which is located less deeply in the lamp holder than the initial position of the lamp after insertion and before rotation.

The known lamp has a number of great disadvantages.

When the lamp is inserted, it must be translated and rotated. In case a luminaire must be provided with a large number of lamps, such as, for example, a matrix panel for, for example, traffic signalization, the lamp requires very complicated equipment to provide a panel with all the lamps required simultaneously in one operation.

Since when the lamp is inserted in a lamp holder, it must first be positioned so that the grooves are located beside the holding members in order that these holding members can be introduced into the grooves by rotation of the lamp, the lamp holder must be comparatively commodious and the lamp has lateral space in the lamp holder.

The depth position of the lamp in the lamp holder depends upon the effect of the elastic means of the lamp holder. Consequently, it is uncertain what depth a lamp will ultimately have in a lamp holder.

SUMMARY OF THE INVENTION

The invention has for its object to provide a lamp of the kind described in the opening paragraph, which inter alia has a construction which makes it possible to readily insert the lamp in a lamp holder and nevertheless to position it accurately and keep it positioned even in the case of shocks and vibrations. The invention further has for its object to provide a lamp holder for this lamp.

According to the invention, this lamp is obtained in that the grooves are widened and deepened towards the respective major side face.

The lamp can readily be inserted in a holder by a simple translation. Rigid holding members of the holder then slide along the minor faces of the pinch seal, while the lamp holder is elastically deformed. When the grooves have reached the holding members, these members penetrate into a respective groove. The tool which performed the translation of the lamp can then be removed.

The holding members of the lamp holder intended for the lamp are not yet located entirely in the grooves. As a result, an elastic deformation of the lamp holder still exists. This elastic deformation and hence the clamping force exerted by the lamp holder on the lamp can become smaller due to the fact that the holding members can slide in the grooves to an area at which the grooves are wider and also deeper and can receive a larger part of the holding members. The holding members slide in the grooves due to the fact that the lamp in the holder is subjected to a rotation due to the clamping force exerted by the holder. This rotation urges the lamp against walls of the holder, as a result of which the lamp occupies a predetermined position.

The translation of the lamp, when it is inserted in the holder, and the following rotation due to the initial elastic deformation of the lamp holder together form a movement along an L-shaped path. The coupling of the lamp to the holder has the effect of a bayonet coupling due to the fact that the return path can be covered only in that first a greater clamping force of the holder on the lamp is produced.

In a favourable embodiment, the grooves are widened more strongly in the direction away from the end face of the pinch seal than in the direction towards the end face of the pinch seal. As a result, upon rotation in the lamp holder, the lamp can be pulled more deeply into the lamp holder so that it engages more firmly an axial abutment stop.

The lamp according to the invention can be readily inserted in the associated holder, the final position of the lamp being determined with high accuracy. Vibrations to which the lamp is subjected rather have a favourable rather than an unfavourable effect on the retention of the lamp by the holder. Vibrations can reduce friction between the holding members and the grooves, as a result of which the lamp can be subjected to an additional small rotation.

It is not essential to the invention whether the electric element of the lamp is an electrode pair in an ionizable medium or a filament, as the case may be arranged in a halogen-containing gas. Due to the fact that the lamp does not comprise a lamp cap, but can be directly arranged in a holder, very short lamps can be obtained, for example having an axial dimension of 15 mm.

The holder for the lamp according to the invention is a body having a substantially rectangular cavity for receiving the pinch seal of the lamp and provided with rigid holding members, characterized in that the holding members are spherically curved projections, which are arranged diametrically opposite each other on the minor side of the rectangular cavity near a respective major side of said rectangular cavity.

BRIEF DESCRIPTION OF THE DRAWING

Embodiments of the lamp and the holder according to the invention are shown in the drawing. In the drawing.

DESCRIPTION OF THE PREFERRED EMBODIMENT

Figure 1:
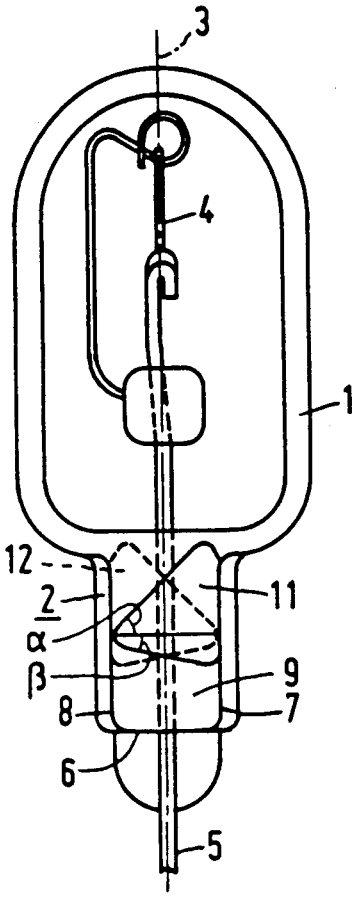
FIG. 1 is a side elevation of a lamp.
Figure 2:
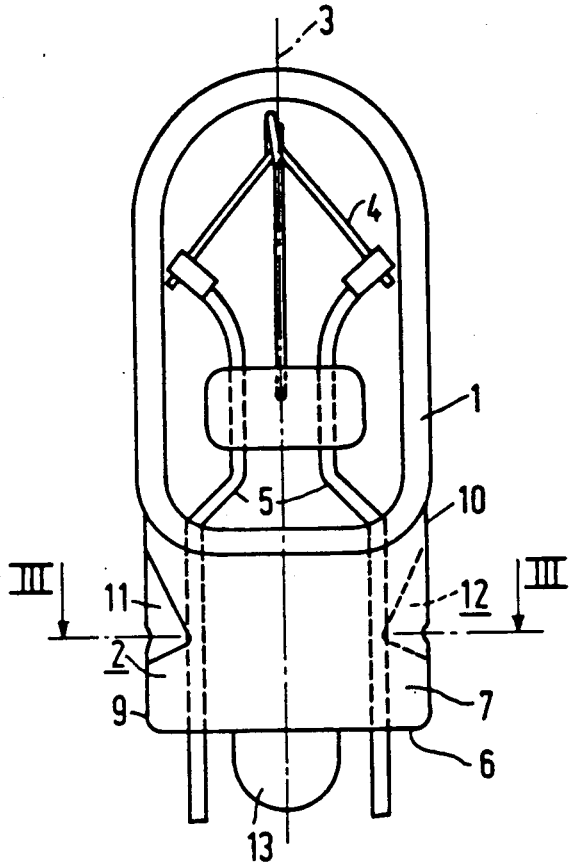
FIG. 2 shows the lamp of FIG. 1 rotated through 90°.
Figure 3:
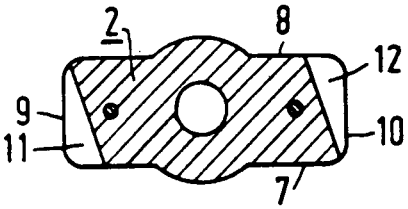
FIG. 3 shows a sectional view of the lamp taken on III—III in FIG. 2.

The electric lamp shown in FIGS. 1 - 3 has a glass lamp vessel 1 with a pinch seal 2 and an axis 3. An electric element 4, i.e. a filament, is arranged in the lamp vessel. Current supply conductors 5 extend from the electric element 4 through the pinch seal 2 to the exterior.

The pinch seal 2 has an end face 6 transverse to the axis 3 of the lamp vessel 1, two opposite major side faces 7, 8 and two opposite minor side faces 9, 10. Each of the minor side faces 9, 10 has a groove 11, 12 which extends—in the drawing at right angles to the axis 3—as far as a respective major side face 7, 8. The grooves 11, 12 have the axis 3 of the lamp vessel as axis of symmetry.

In the lamp shown, a sealed exhaust tube 13 is accommodated in the pinch seal 2. However, this is not essential to the lamp according to the invention. Instead of a glass exhaust tube, a metal exhaust tube could have been present. The exhaust tube could further have been present, if the lamp has an exhaust tube at all, opposite to the pinch seal, although for certain applications this can have an excessively disturbing influence on a light beam to be produced.

According to the invention, the grooves 11, 12 are widened and deepened towards the major side faces 7 and 8, respectively. In the lamp shown in the Figures, the grooves are widened more strongly in the direction away from the end face 6 than in the direction towards the end face 6 ($\alpha > \beta$).

Figure 5:
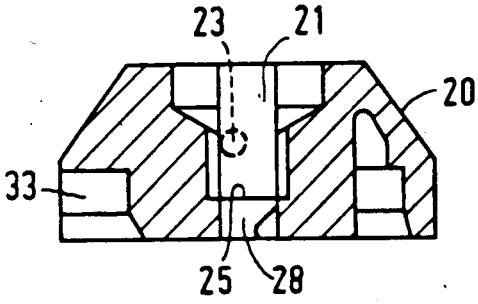
FIG. 5 is a sectional view taken on V—V in FIG. 4.
Figure 4:
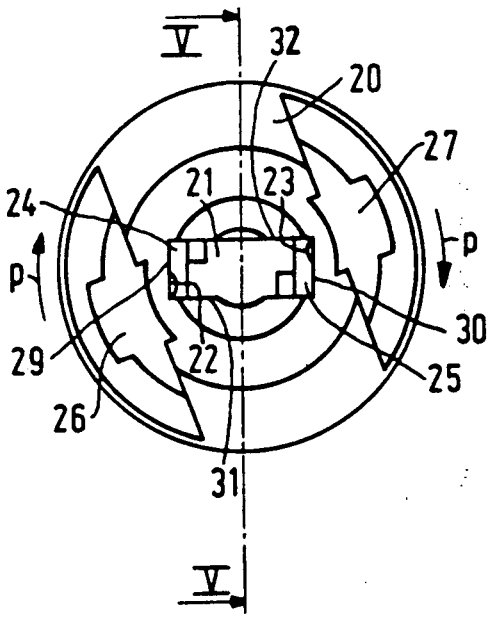
FIG. 4 is a plan view of a holder for the lamp of FIGS. 1-3.

The holder 20 of FIGS. 4 and 5 is a body of synthetic material having a substantially rectangular cavity 21 for receiving the pinch seal 2. The holder 20 is provided with rigid holding members 22, 23, which are spherically curved projections, which are arranged diametrically opposite each other on the minor sides 29, 30 of the rectangular cavity 21 near the major sides 31, 32 of said rectangular cavity. The holder has axial abutment stops 24, 25 for the lamp. Hooks can grip through openings 26, 27 and secure the holder 20 to, for example, a printed circuit board. The holder 20 shown has an opening 28, through which the current supply conductors 5 of a lamp can extend to the exterior, which can be laterally bent to make contact with a printed circuit board and can be passed through a respective gap 33. In FIG. 4, arrows P indicate the direction in which a lamp, after having been arranged in the holder 20, is forced due to the elastic deformation of the holder by the cooperating holding members 22, 23 and the grooves 11, 12.

We claim:

1. An electric lamp comprising a glass lamp vessel (1) having a pinch seal (2) and an axis (3), an electric element (4) in the lamp vessel, current supply conductors (5) extending from the electric element through the pinch seal to the exterior, which pinch seal has an end face (6) transverse to the axis of the lamp vessel and two opposite major side faces (7, 8) and two opposite minor side faces (9, 10), each of the minor side faces (9, 10) having a groove (11 and 12, respectively), which extends as far as a respective major side face (7 and 8, respectively), which grooves have the axis of the lamp vessel as an axis of symmetry, characterized in that the grooves (11, 12) are gradually widened and deepened towards the respective major side faces (7, 8).

2. An electric lamp as claimed in claim 1, characterized in that the grooves (11, 12) are widened more strongly in the direction away from the end face (6) than in the direction towards said end face.

3. A holder for a lamp as claimed in claim 1 or 2, comprising a body having a substantially rectangular cavity (21) for receiving the pinch seal (2) of a lamp and provided with rigid holding members (22, 23), characterized in that the holding members (22, 23) are spherically curved projections, which are arranged diametrically opposite each other on the minor sides (29, 30) of the rectangular cavity (21) near a respective major side (31 and 32, respectively) of said rectangular cavity.

* * * * *